United States Patent [19]

Saylor et al.

[11] Patent Number: 5,035,796

[45] Date of Patent: Jul. 30, 1991

[54] LIQUID LINE CHLORINE CLEANER

[76] Inventors: Robert F. Saylor, 119 E. Main, Potterville, Mich. 48876; George Spector, 233 Broadway, New York, N.Y. 10007

[21] Appl. No.: 484,505

[22] Filed: Feb. 26, 1990

[51] Int. Cl.[5] ..... B08B 1/00

[52] U.S. Cl. ..... 210/198.1; 210/251; 15/104.05; 15/104.16; 239/123; 134/167 C; 134/168 C

[58] Field of Search ..... 210/198.1, 251; 15/104.05, 104.16; 239/123; 134/167 C, 168 C

[56] References Cited

U.S. PATENT DOCUMENTS 4,605,028 8/1986 Paseman ..... 134/167

*Primary Examiner*—Robert A. Dawson
*Assistant Examiner*—David Reifsnyder

[57] ABSTRACT

A liquid chlorine injection line cleaner is provided and consists of a cylindrical housing with a built-in cleaning mechanism between a pipe line from a liquid chlorine metering pump and a water main line so as to prevent liquid chlorine chemical build up and line blockage.

3 Claims, 1 Drawing Sheet

LIQUID LINE CHLORINE CLEANER

BACKGROUND OF THE INVENTION

The instant invention relates generally to plumbing fixtures and more specifically it relates to a liquid chlorine injection line cleaner which provides a built-in mechanism to keep a liquid chlorine metering pump line clear to a water main line.

There are available various conventional plumbing fixtures which do not provide the novel improvements of the invention herein disclosed.

SUMMARY OF THE INVENTION

A primary object of the present invention is to provide a liquid chlorine injection line cleaner that will overcome the shortcomings of the prior art devices.

Another object is to provide a liquid chlorine injection line cleaner that includes a built-in cleaning mechanism within a housing between a pipe line from a liquid chlorine metering pump and a water main line so as to prevent liquid chlorine chemical build up and line blockage.

An additional object is to provide a liquid chlorine injection line cleaner in which the brush mechanism is removable from the housing so that the brush mechanism can be replaced when worn out.

A further object is to provide a liquid chlorine injection line cleaner that is simple and easy to use.

A still further object is to provide a liquid chlorine injection line cleaner that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2:
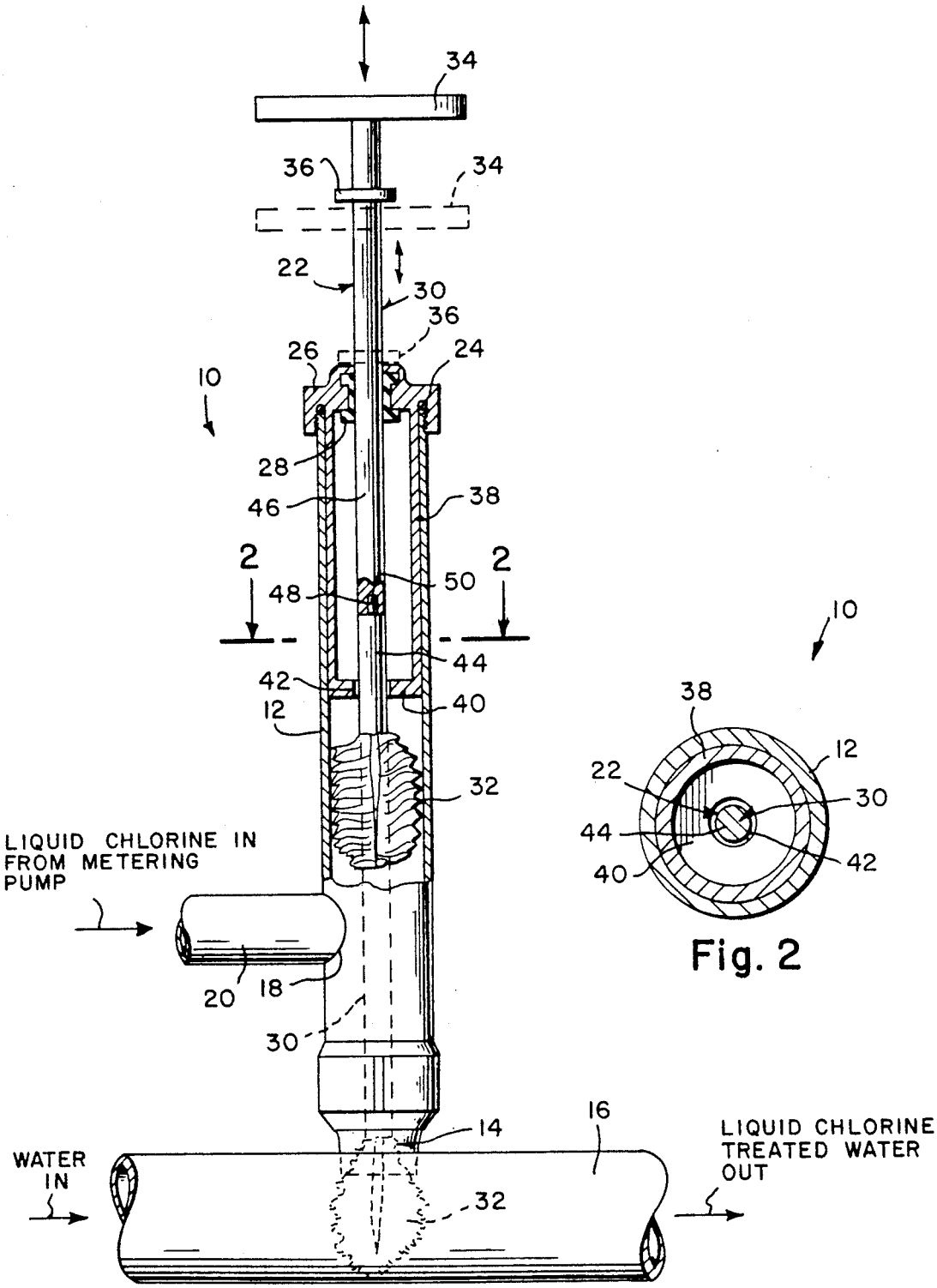
FIG. 1 is an elevational view with parts broken away and in section of the instant invention.
FIG. 2 is a cross sectional view taken along line 2—2 in FIG. 1.

Turning now descriptively to the drawings, in which similar reference characters denote similar elements throughout the several views, FIGS. 1 and 2 illustrate a liquid chlorine injection line cleaner 10 consisting of an elongated cylindrical housing 12 having a bottom injection point 14 attached transversely into a water main line 16 and a low, side injection port 18 connected to a pipe line 20 from a liquid chlorine metering pump. A cleaning mechanism 22 is carried within the housing 12, so that when the cleaning mechanism 22 is manually operated it will remove a liquid chlorine chemical build up from the injection port 18 and the injection point 14, to keep the liquid chlorine metering pump running free from line blockage.

The cleaning mechanism 22 includes an o-ring 24 to fit upon top end of the housing 12. An internally threaded cap 26 threads onto the top end of the housing

12 over the o-ring 24 so as to seal the cap 26 thereto. A gasket seal 28 is carried within the cap 26 with an operating rod 30 extending upwardly through the gasket seal 28. A reciprocating wire brush head 32 is connected to inner end of the rod 30. A handle 34 is affixed to outer end of the rod 30 so that a person can grip the handle and move the wire brush head 32 up and down within the housing 12.

The cleaning mechanism 22 further includes a stop member 36 affixed onto the rod 30 to limit downward movement of the rod 30 through the cap 26 so that the wire brush head 32 will travel a proper distance past the injection point 14 into the water main line 16 and not become damaged.

A guide tube 38 extends downwardly from the cap 26 and is sized to fit into the housing 12, while a guide plate 40 is affixed to bottom of the guide tube 38. The guide plate 40 has a central aperture 42 so that the rod 30 can extend therethrough and be centrally positioned with respect to the housing 12.

The rod 30 can be segmented into two parts 44 and 46 in which part 44 has a threaded post 48 and part 46 has a threaded hole 50 so that the part 44 with the wire brush head 32 can be separated and replaced with a new one when needed.

To operate the line cleaner 10, push the handle 34 down so that the rod 30 will travel down until stop member 36 hits the cap 26. At this position the wire brush head 32 will clean the injection point 14 in the water main line 16. Then pull the handle 34 up so that the rod 30 will travel up until the wire brush head 32 will pass the injection port 18 and clean it. Repeating the operation several times at least two or three times a week will keep the passages open.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A liquid chlorine injection line cleaner comprising: a) an elongated cylindrical housing having a bottom injection point attached transversely into a water main line and a low, side injection port connection to a pipe line from a liquid chlorine metering pump; and b) a cleaning mechanism carried within said housing so that when said cleaning mechanism is manually operated it will remove a liquid chlorine chemical build up from said injection port and said injection point, to keep the liquid chlorine metering pump running free from line blockage; wherein said cleaning mechanism includes: c) an o-ring to fit upon top end of said housing; d) an internally threaded cap to thread onto the top end of said housing over said o-ring so as to seal said cap thereto; e) a gasket seal carried within said cap; f) an operating rod extending upwardly through said gasket seal; g) a reciprocating wire brush head connected to inner end of said rod; and h) a handle affixed to outer end of said rod so that a person can grip said handle and move said wire brush head up and down within said housing.

2. A liquid chlorine injection line cleaner as recited in claim 1, wherein said cleaning mechanism further includes a stop member affixed onto said rod to limit downward movement of said rod through said cap so that said wire brush head will travel a proper distance past the injection point into the water main line and not become damaged.

3. A liquid chlorine injection line cleaner as recited in claim 2, further including: a) a guide tube extending downwardly from said cap and sized to fit into said housing; and b) a guide plate affixed to bottom of said guide tube, said guide plate having a central aperture so that said rod can extend therethrough and be centrally positioned with respect to said housing.

* * * * *